United States Patent [19]

Goren et al.

[11] 3,987,640

[45] Oct. 26, 1976

[54] COLUMN STABILIZED SEMISUBMERSIBLE PIPELAYING BARGE

[75] Inventors: Yoram Goren, Los Angeles; Charles N. Springett, Irvine, both of Calif.

[73] Assignee: Santa Fe International Corporation, Orange, Calif.

[22] Filed: Nov. 21, 1975

[21] Appl. No.: 634,133

Related U.S. Application Data

[63] Continuation of Ser. No. 537,784, Dec. 30, 1974, Pat. No. 3,924,415.

[52] U.S. Cl. ..... 61/111; 61/72.1; 114/.5 R

[51] Int. Cl.[2] ..... B63B 35/04

[58] Field of Search ..... 61/72.1–72.7, 61/46.5, 46; 114/.5 R, .5 D; 212/3

[56] References Cited

UNITED STATES PATENTS

| | | | |
|---|---|---|---|
| 3,653,349 | 4/1972 | Brown | 114/.5 D |
| 3,685,305 | 8/1972 | Lloyd | 61/72.3 |
| 3,704,596 | 12/1972 | Lloyd | 61/72.3 |
| 3,835,800 | 9/1974 | Lloyd et al. | 114/.5 R |
| 3,854,297 | 12/1974 | Broussand et al. | 61/72.3 |
| 3,872,814 | 3/1975 | Rodriguez | 114/.5 D X |

*Primary Examiner*—Dennis L. Taylor
*Attorney, Agent, or Firm*—LeBlanc & Shur

[57] ABSTRACT

The pipelaying barge comprises a pair of laterally spaced, elongated hulls having a plurality of upstanding columns spaced therealong supporting a working platform in spaced relation above the hulls and on which platform is carried a pipe section assembly line and one or more cranes movable longitudinally along the platform and capable of servicing the pipe section assembly line. The hulls have ballast compartments to submerge the hulls and portions of the stabilizing columns to a high draft condition with the mean waterline at a necessary and desirable locus intermediate the height of the stabilizing columns. A transition segment is connected to the stern of the barge for support of the "air length" segment of the pipeline between the stern of the barge and the point of entry of the pipeline into the water and preferably also supporting a short segment of pipeline in the water as the pipeline is payed out from the barge. To lay pipe, the pipelayer barge is disposed in the high draft condition and ballasted to provide a preset angle of trim. The attitude of the barge in trim about the pitch axis when in high draft pipelaying condition is maintained within an angle not in excess of plus or minus one-half degree of the preset trim to avoid introducing undesirable pipe stresses due to change in the attitude of the barge in trim about the pitch axis caused by longitudinal movement of one or more cranes; further, change in trim angle exceeding plus or minus one-half degree is offset by ballast correction correlated to longitudinal location and movement of the crane to maintain the barge trim within plus or minus one-half degree of the preset trim angle whereby pipelaying and crane operations can be performed simultaneously without interruption.

7 Claims, 23 Drawing Figures

FIG14E
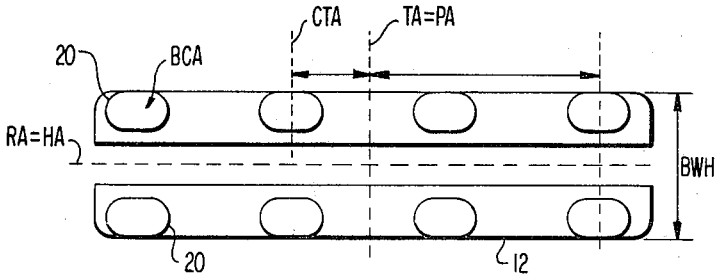
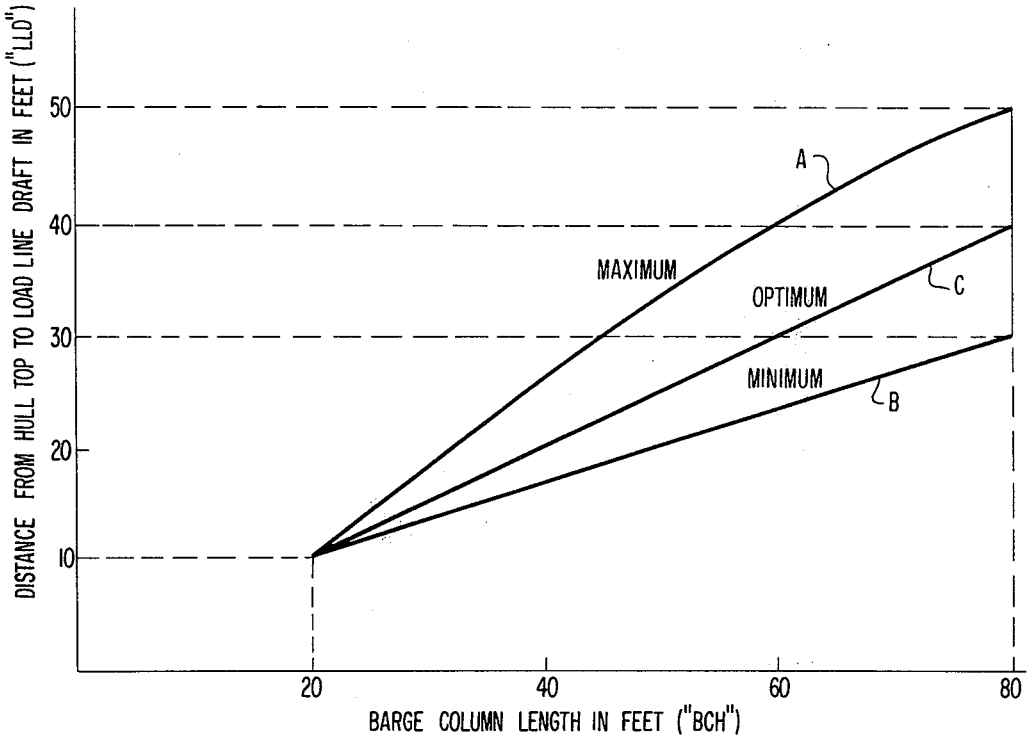
FIG. 13

COLUMN STABILIZED SEMISUBMERSIBLE PIPELAYING BARGE

This is a continuation of application Ser. No. 537,784 filed Dec. 30, 1974, now U.S. Pat. No. 3,924,415.

This invention relates to a pipelaying barge, and more particularly to a twin hull column stabilized semisubmersible pipe laying barge carrying a pipe assembly line and means for laying pipeline onto the sea bottom and to methods of operating such barge.

Increased offshore activities, such as attempts to drill and exploit gas and oil wells at sea, have created a demand for underwater pipelines for transporting gas and oil from offshore wells or production sites to near-shore or on-shore terminals for storage and/or ultimate delivery of the gas and/or oil to refineries and to the consumer. To date, large numbers of pipelines have been laid offshore along the sea bottom by conventional pipelaying barges to connect the production sites with the near-shore or on-shore facilities. Such conventional barges are usually characterized by a single standard barge hull which is generally rectangular in shape (with a bow at the front) and operates in surface floating condition (not semi-submerged) with a pipe section assembly line normally disposed along the hulls topside and along which pipe sections are welded one to the other; the pipeline is payed out from the stern of the barge which is not much above the water line and generally over a stinger which extends from the barge stern and supports the portion of the pipeline which initially enters the water. Pipelaying operations have heretofore generally been conducted in relatively calm or sheltered waters; where conducted in regions having medium to high seas (waves in excess of 4 to 5 feet) such operations are usually suspended until such seas subside and calm conditions arise. That is, conventional pipelaying operations are highly restricted by sea state condition since excessive motion in pitch, heave and roll, especially pitch, can excessively stress the pipe to cause rupture of the pipe and/or its concrete coating. Also, on-deck equipment often is damaged or lost due to wave action.

Conventional pipelaying barges which are single hull surface floating vessels have stability characteristics which provide excessive motion in even moderate sea conditions whereby pipelaying operations are highly restricted by sea state conditions since excessive vessel motion in heave, pitch and roll even in relatively moderate sea conditions can alter the curvature of the pipeline being laid to the extent of exceeding allowable stresses with resultant rupture of pipe or coating. For example, surface floating pipelaying barges of this type can operate only in sea states having wave heights up to about 4 or 5 feet or in special cases 6 feet. Wave action against such barges, when in sea states having wave heights in excess of these limits, normally causes excessive vessel motion which precludes pipelaying operations. Such conventional single hull vessels have inherently low natural periods in roll, pitch and heave and inherently high GM. The low natural periods are apt to be close to the period of the waves, thus causing motion amplification while a high GM results in high stability and consequent abrupt and large correcting motions when the barge is subjected to roll and pitch excitations. The above-discussed stability and motion characteristics of the described conventional pipelaying barges do not permit pipelaying operations to proceed in medium and high sea states.

Due particularly to the discovery and exploitation of oil and gas in the North Sea and other offshore areas which are consistently and continuously subject to relatively high wind and sea states, there has been and is a need for a vessel which can operate to continuously lay pipe in such waters notwithstanding such high sea states. Pipelines have been and are continuing to be successfully laid in one such region, i.e. the North Sea, by two semisubmersible twin hull column stabilized derrick barges of the type disclosed in U.S. Pat. Nos. 3,835,800 and 3,685,305 and 3,704,596 (owned by the assignee of this application) such derrick barges having been modified to carry pipe assembly lines and ancillary equipment for pipelaying operations and including deck-to-water pipe section transition stingers such as disclosed in said U.S. Pat. Nos. 3,685,305 and 3,704,596.

The present invention provides a novel improved semi-submersible twin hulled column stabilized pipelaying barge construction aad system which not only provides advantages over above-discussed conventional pipelaying barges (which are fundamentally different from the pipelaying vessel of this application), but also provides novel features and advantages for pipelaying which are not incorporated as such in the vessels disclosed in the three patents identified in the immediately preceding paragraph.

Accordingly, it is a primary object of the present invention to provide novel and improved apparatus and methods of operation relating to a semisubmersible column stabilized pipelaying barge which would generally preclude pipelaying operations by conventional single hull barges and which also provides new advantageous features as compared to the aforementioned semisubmersible derrick barges of assignee's aforementioned patents when used as pipe layers.

It is another object of the present invention to provide a novel and improved column stabilized semisubmersible twin hull pipelaying barge having one or more cranes movable longitudinally along the barge platform for general lifting purposes including resupply of pipe sections to the barge and to the pipe assembly line from supply boats; and novel and improved methods for operating such barge in semi-submerged high draft condition.

It is still another object of the present invention to provide a novel and improved twin hull semisubmersible column stabilized pipelaying barge and method of operating such barge wherein the barge in high draft condition is ballasted in correlation to the location and/or movement of the crane or cranes along the platform to maintain the attitude of the barge in trim within a predetermined angle of change from the operational trim angle set prior to change in location and/or movement of the crane or cranes along the barge and to maintain such angle within narrow limits to prevent excess resultant stresses on the pipeline exceeding allowable stresses which would damage the pipeline and/or any coating applied to the pipeline.

It is a further object of the present invention to provide a novel and improved twin hull semisubmersible column stabilized pipelaying barge and method of operating such barge wherein the barge in high draft condition is ballasted in conjunction with and correlation to the location and/or movement of the crane or cranes along the platform to maintain the attitude of the barge in trim within plus or minus one-half degree of a preset operational trim angle.

It is a still further object of the present invention to provide a novel and improved twin hull semisubmersible column stabilized pipelayer barge with means for establishing proper distance between the top of the hulls and the mean waterline at "load line draft" in the high draft condition of the barge for such pipelaying barges having a particular column height between the hulls and platform.

It is an even further object of the present invention to provide a novel and improved pipelaying combination including a twin hull semisubmersible column stabilized pipelayer barge and a pipeline transition segment wherein the pipeline transition segment is adjustable about a transversely extending axis in relation to the attitude of the barge about its trim axis and to the horizontal to control the curvature of the pipeline extending from the barge and over the pipeline transition segment so as not to exceed allowable stresses on the pipeline and its coating and also with such adjustment being made in conjunction with and correlation to operation of the ballast means for maintaining the draft of the barge in the desired high draft condition and also maintaining the barge trim angle less than plus or minus one-half degree variation from the preset angle of trim whereby the relative angular relation between the barge and pipeline transition segment is substantially maintained throughout pipelaying operations so as not to exceed allowable stresses on the pipeline and/or its coating.

These and other related objects and advantages of the present invention will become more apparent upon reference to the following specification, appended claims and drawings wherein:

Figure 1:
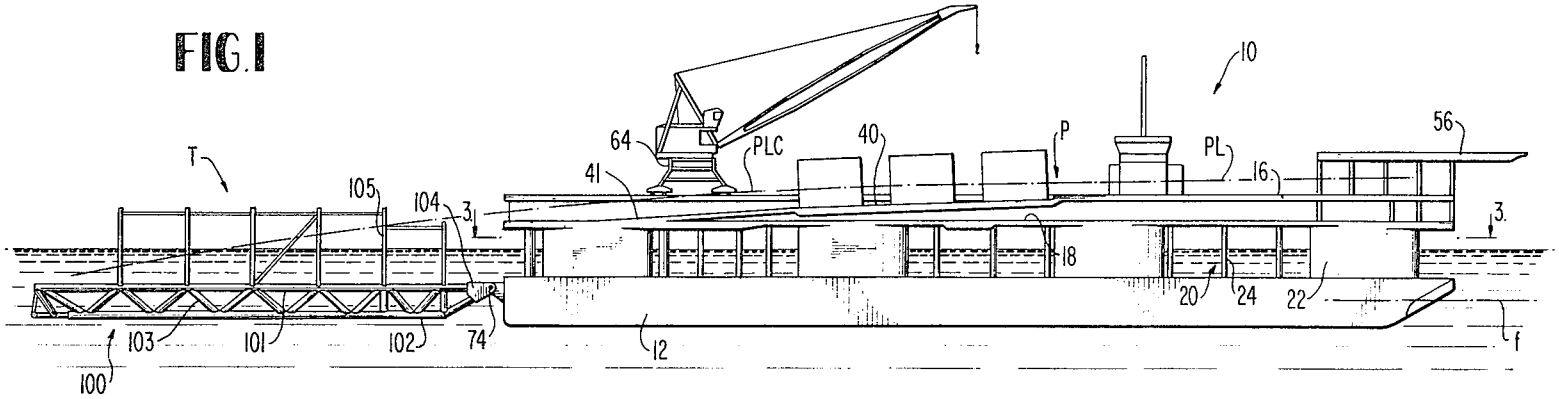
FIG. 1 is a side elevational view of a pipelaying barge constructed in accordance with the present invention with a transition segment illustrated in semi-submerged floating condition for pipelaying operations.
Figure 3:
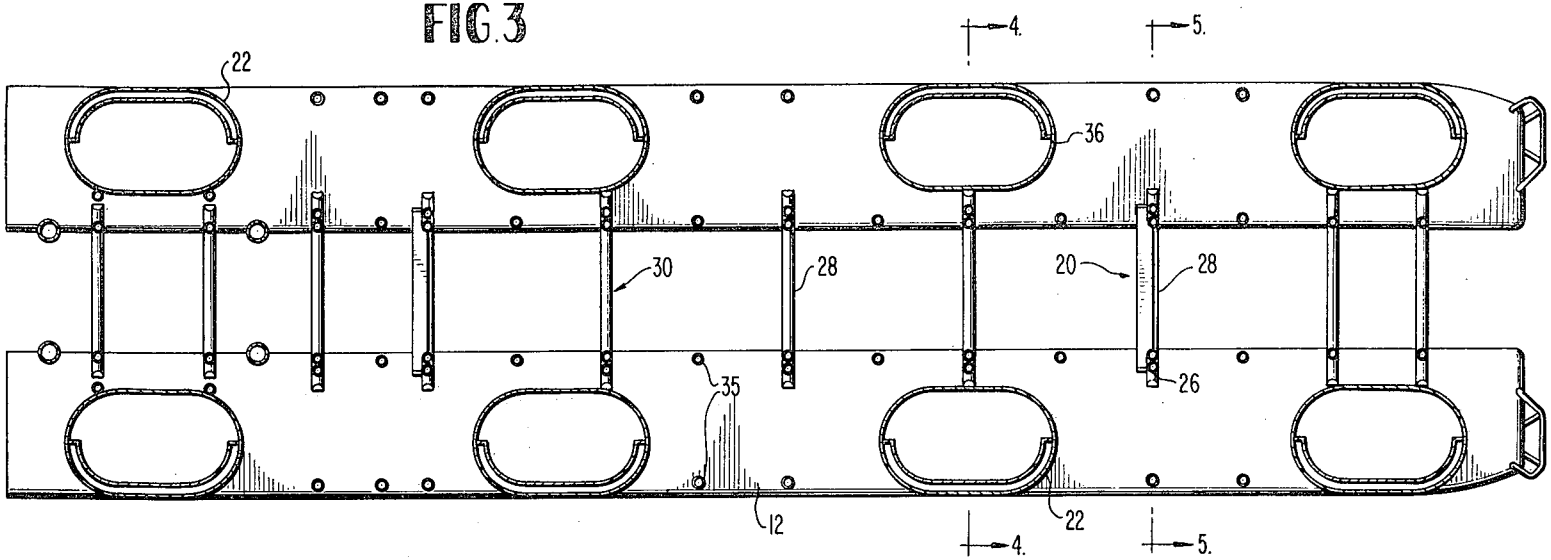
FIG. 3 is an enlarged horizontal cross-sectional view of the barge taken generally about on line 3—3 in FIG. 1.
Figure 5:
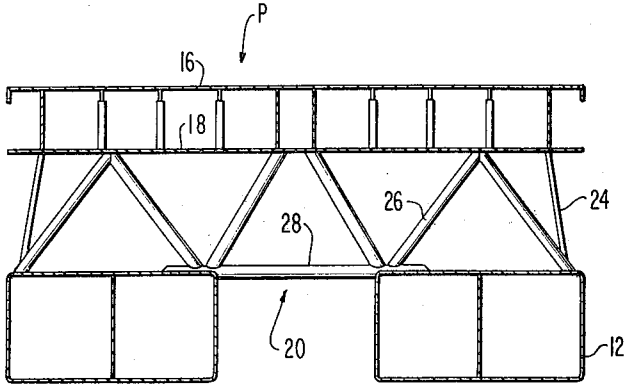
Figure 4:
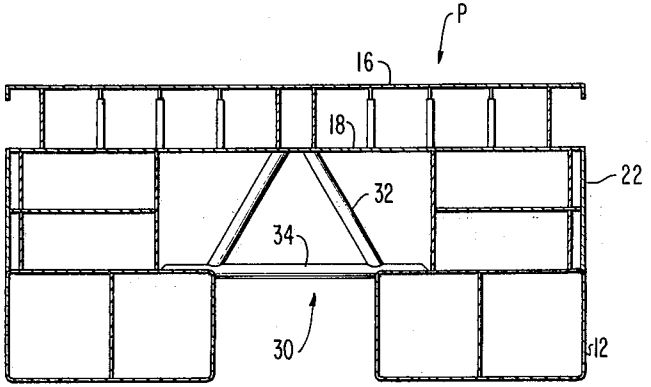
Figure 6:
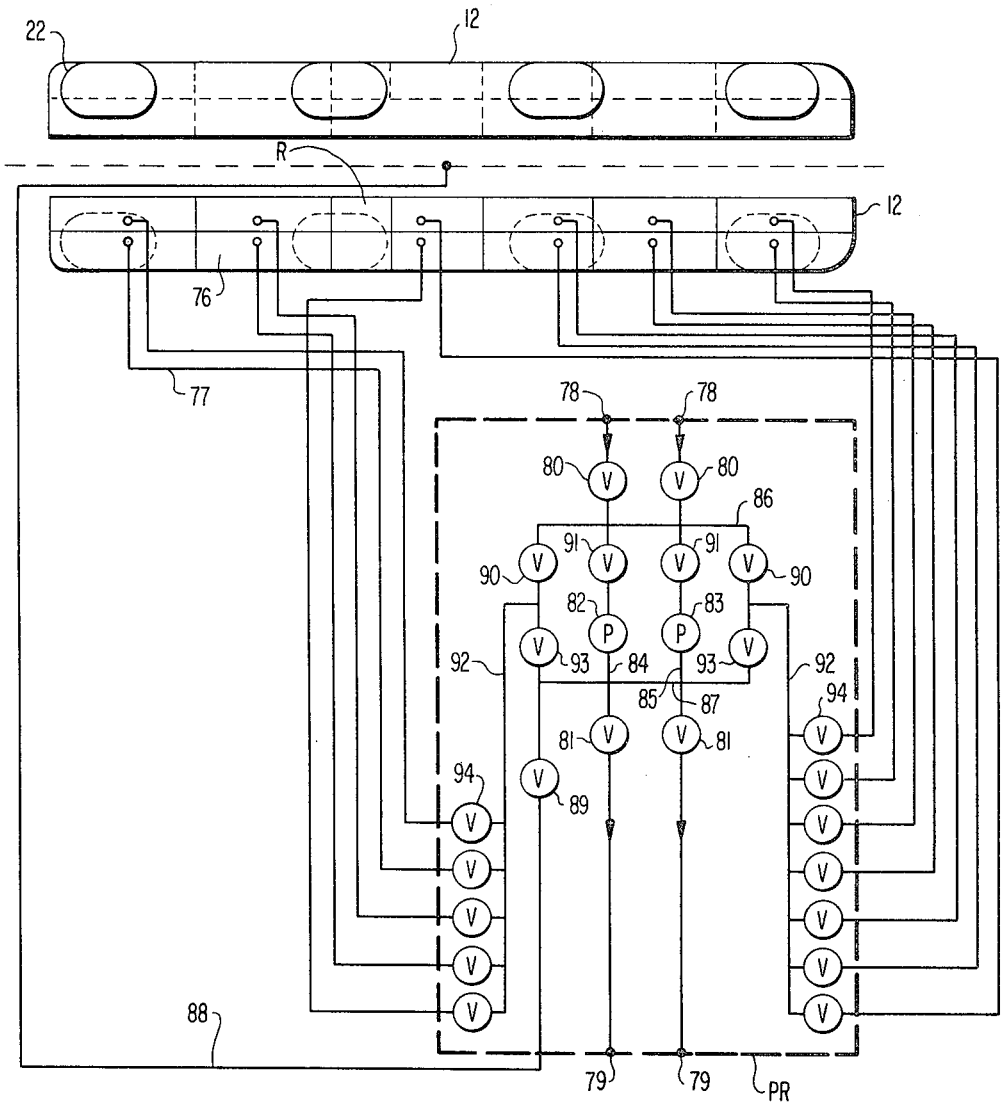
Figure 7:
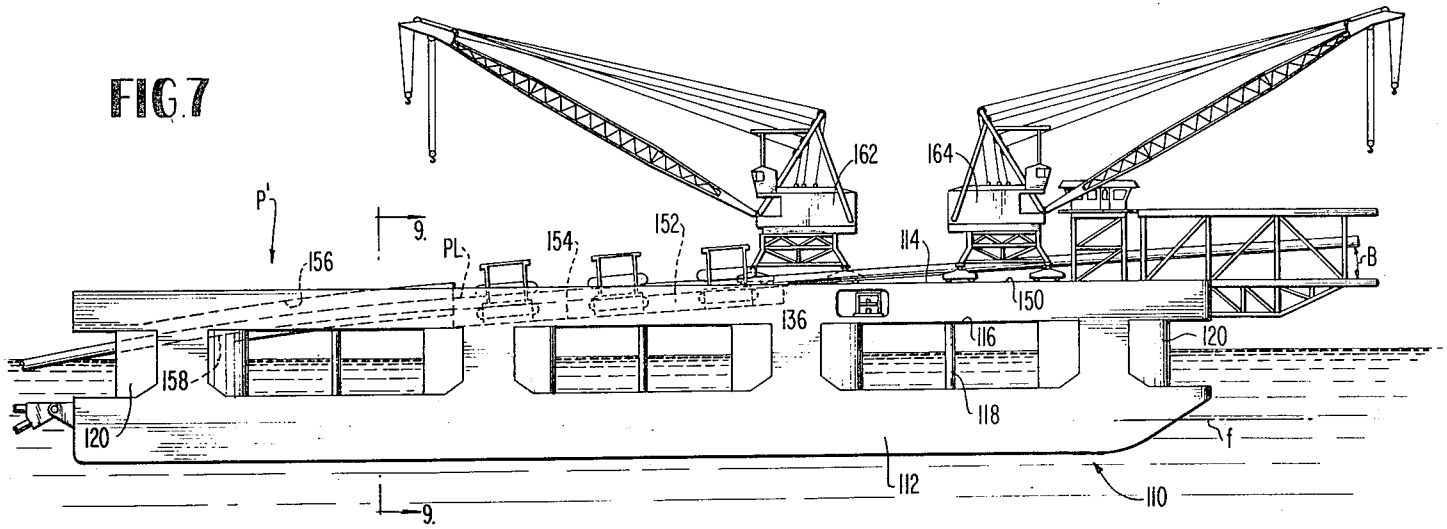
Figure 8:
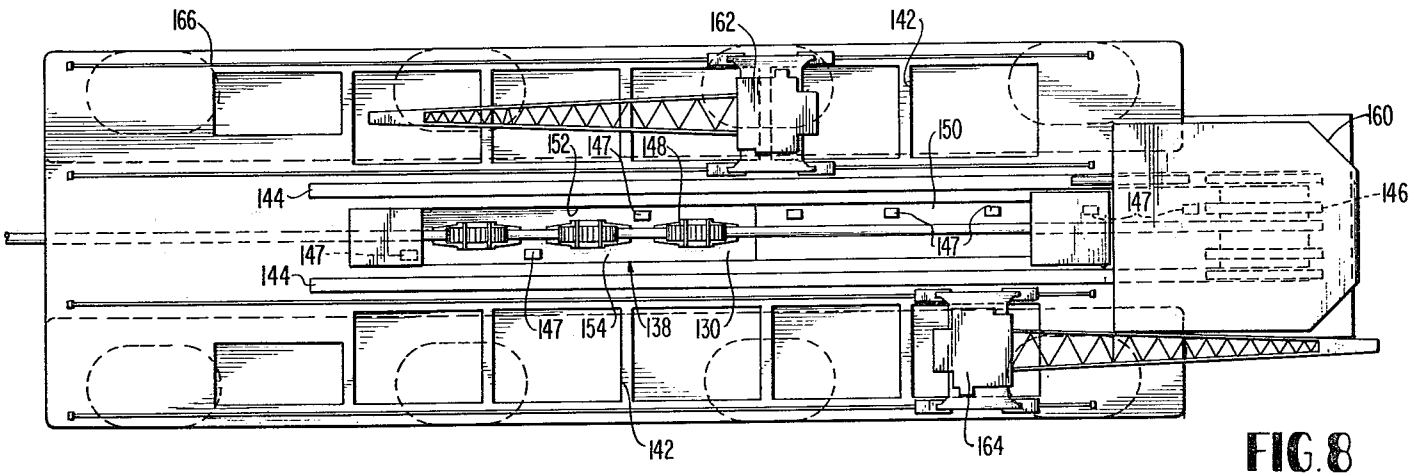
Figure 9:
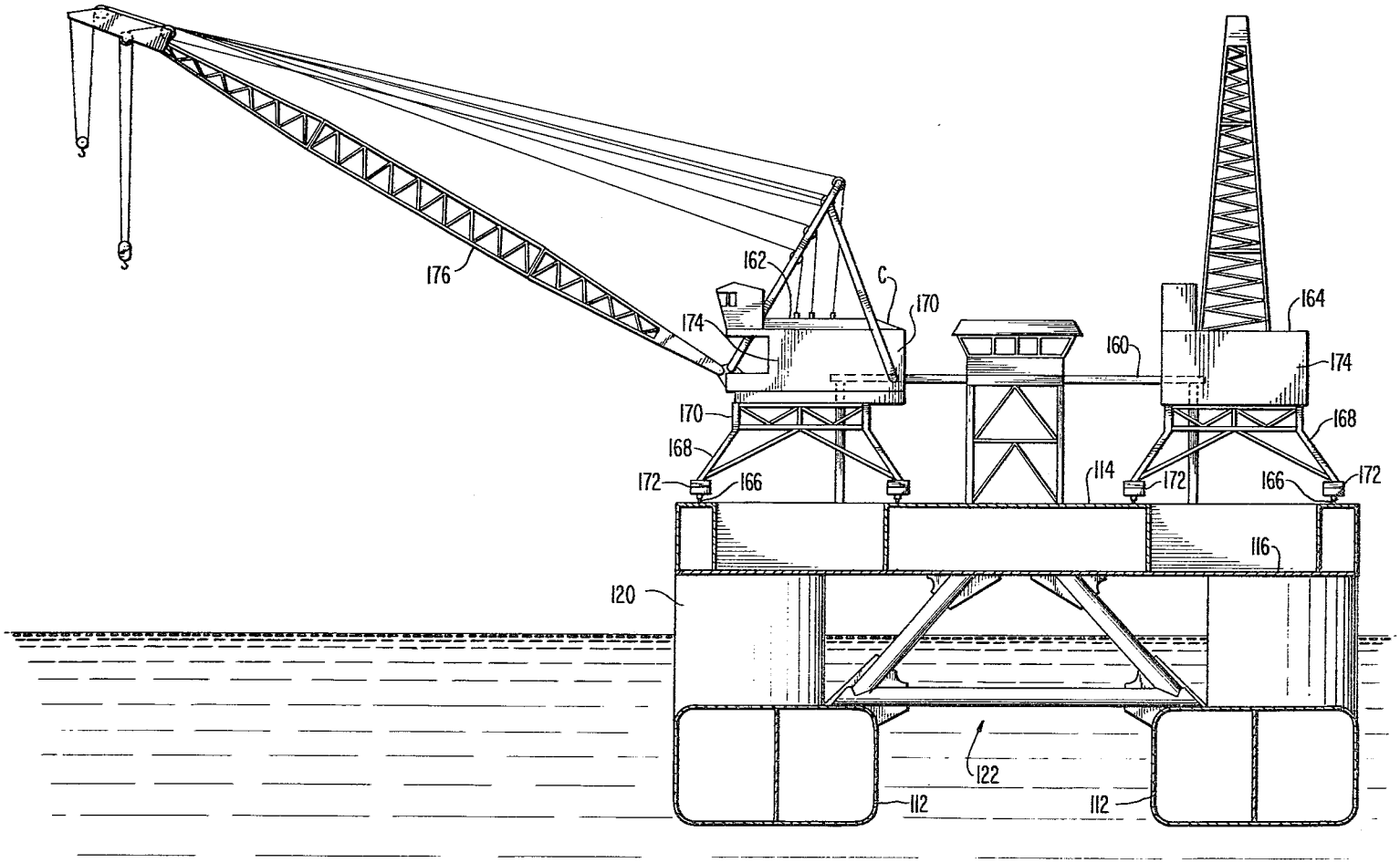
Figure 10:
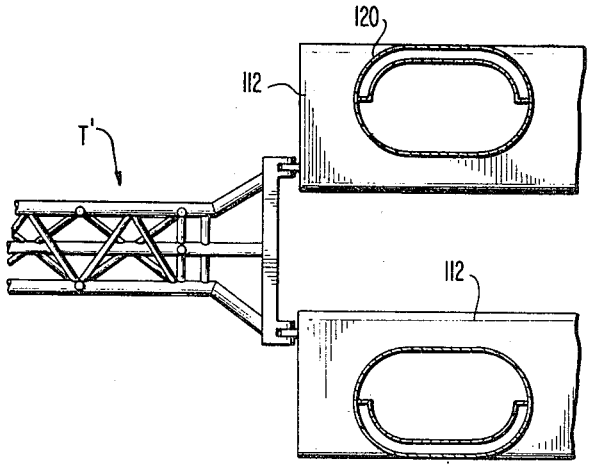
Figure 12A:
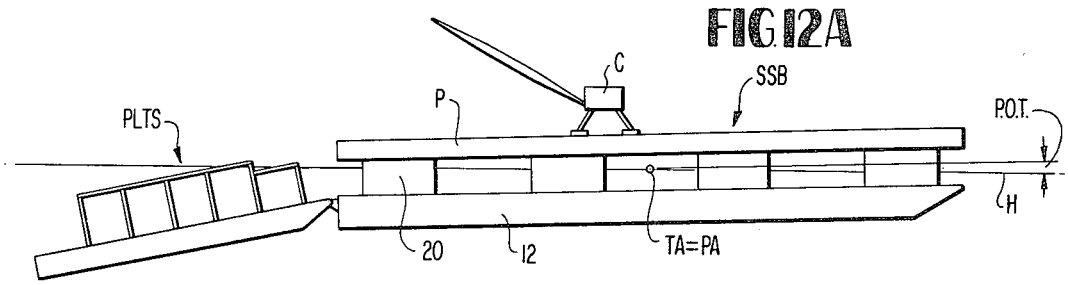
Figure 12B:
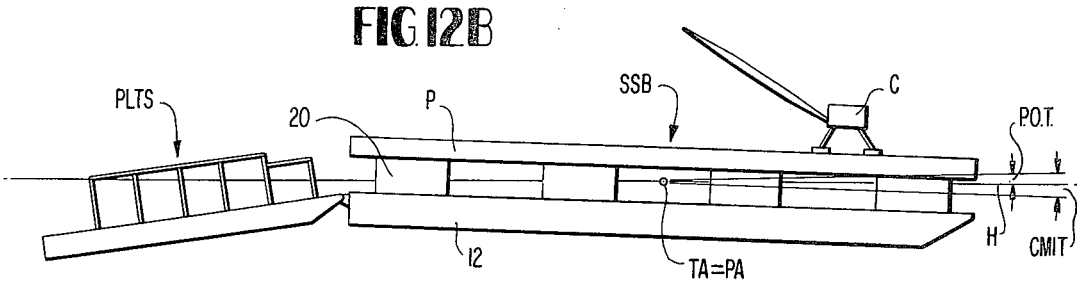
Figure 12C:
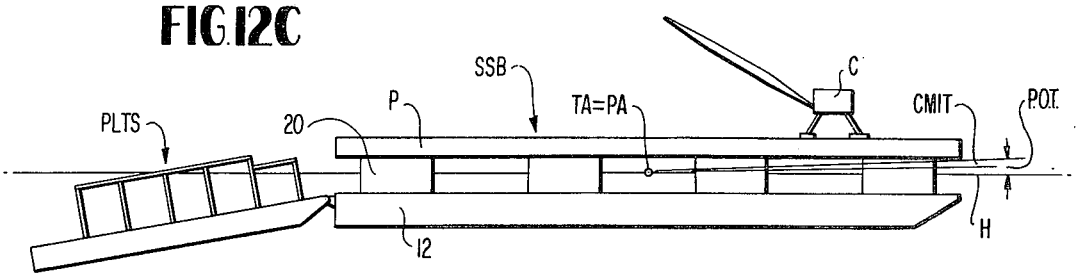
Figure 14A:
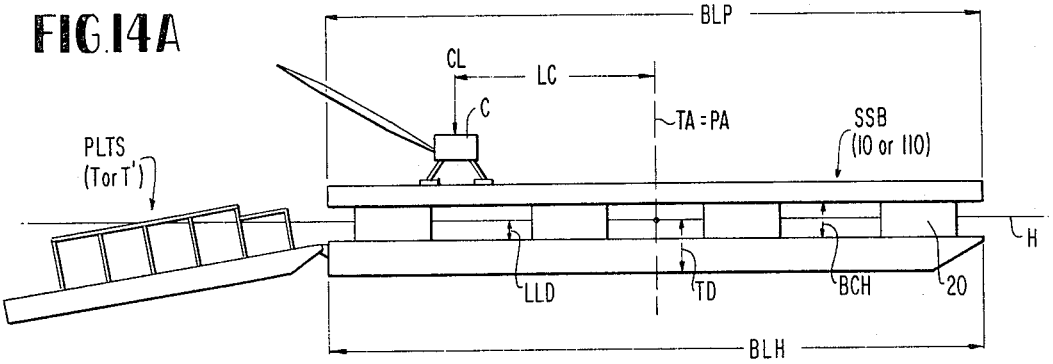
Figure 14B:
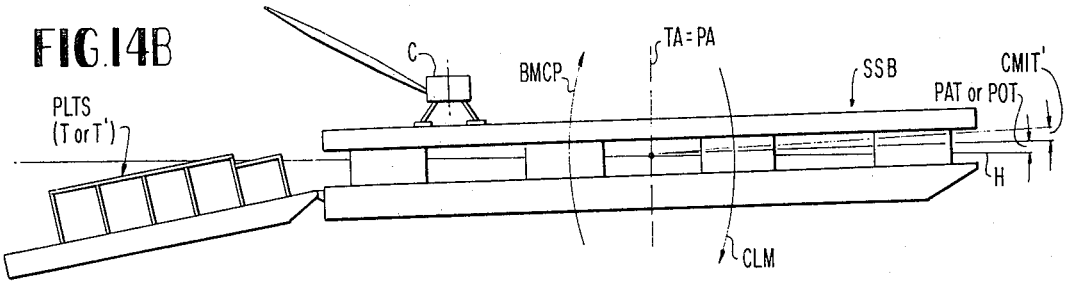

FIGS. 4 and 5 are enlarged cross-sectional views taken generally about on lines 4—4 and 5—5 respectively in FIG. 3;

FIG. 6 is a schematic view of one of the hulls of the vessel illustrating the ballast system therefor;

FIG. 7 is a side elevational view of a pipelaying barge constructed in accordance with another embodiment of the present invention and illustrated in high draft pipelaying condition;

FIG. 8 is a plan view of the pipelaying barge illustrated in FIG. 7;

FIG. 9 is an enlarged cross-sectional view of the barge of FIG. 7 taken generally about on line 9—9 in FIG. 7;

FIG. 10 is a fragmentary horizontal cross-sectional view of the aft end of the barge and plan view of the forward end of the transition segment;

FIGS. 11A, 11B, and 11C and 11D are schematic illustrations of the pipelaying barge illustrating the change in the trim attitude of the vessel in response to longitudinal movement of the crane between stern and pitch axis and the ballast correction to counteract the change in the angle of trim induced by crane movement;

FIGS. 12A, 12B, and 12C are similar schematic illustrations of the barge illustrating changes in the attitude of the barge in response to longitudinal movement of the crane between locations aft and forward of the pitch axis and ballast correction to maintain the attitude of the barge within the preset operational trim attitude;

FIG. 13 is a graph which plots along the ordinate the distance from the hull top to load line draft called "LLD" versus various barge column height "BCH" along the absicca; and FIGS. 14A–14D are schematic illustrations of the pipelaying barge and transition segment (similar to FIGS. 11A–11D and 12A–12C) and FIG. 14E is a schematic illustration in horizontal cross section through the columns; the loads, loci, distances, moments, axes, etc. designated in drawing FIGS. 14A–E, for example "CL", "BMC", "TA", etc. are defined later in the specification for use in the appended claims with reference to drawings FIGS. 14A–E (and other drawing FIGS. such as FIGS. 13 and 1 as discussed below).

Figure 2:
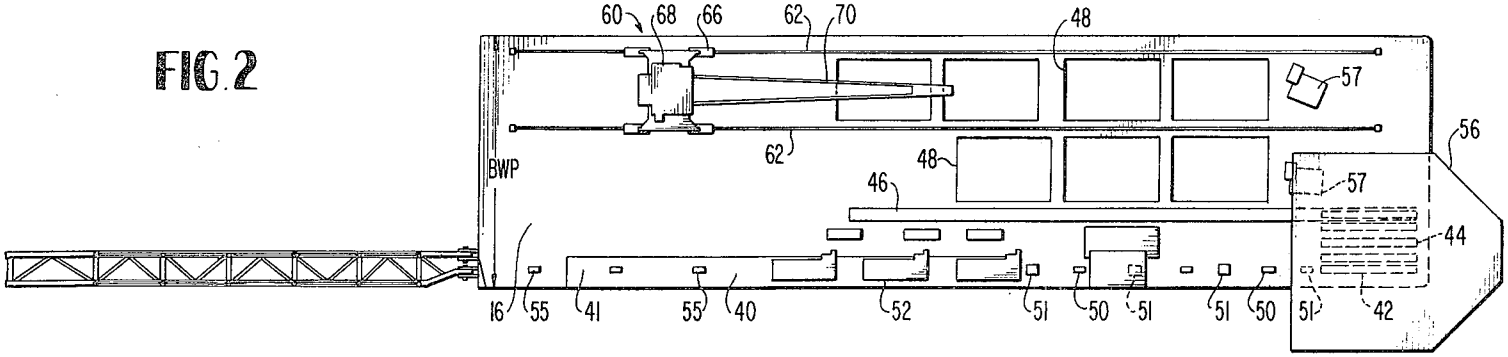
FIG. 2 is a plan view of the pipelaying barge and transition segment shown in FIG. 1.

Referring to the drawings, particularly to FIGS. 1 and 2, there is illustrated a column stabilized, semi-submersible pipe laying barge or vessel constructed in accordance with one embodiment of the present invention and generally indicated 10. Barge 10 includes a pair of transversely spaced, elongated hulls 12 extending in spaced parallel relation and providing sufficient displacement to support barge 10 in a low-draft floating condition with the hulls 12 having freeboard indicated *f* in FIG. 1. Each hull has a bow suitably shaped to reduce resistance to movement of barge 10 through the water when it is moved in the low-draft floating condition. Each hull 12 is also substantially rectangular in cross section with parallel planar top and bottom surfaces extending substantially the entire length of the hull for reasons discussed hereinafter; it will be appreciated, however, that each hull cross section may have rounded corner edges and that the sides of the hulls may be arcuate, i.e., laterally outwardly convex in shape between the top and bottom hull surfaces.

A platform, generally designated P and comprising a main deck 16 and a lower deck 18, is supported a predetermined height above the hulls 12 by support structure including a plurality of longitudinally spaced transversely extending truss formations generally indicated 20 and 30 and a plurality of longitudinally spaced pairs of transversely spaced stabilizing columns 22. As illustrated in FIG. 1, a plurality of the truss formations 20 are longitudinally spaced between each longitudinally spaced pair of columns 22 and each such truss formation includes as illustrated in FIG. 5, two outermost support members 24 upstanding from the outer side of each hull 12 to the outer edges of lower deck 18; a plurality of diagonal or inclined beams 26 secured between each hull 12 and lower deck 18 providing support for platform P; and a transversely extending horizontal cross beam 28 joining the upper inner sides of hulls 12 one to the other. A truss formation 30 connects between hulls 12 in the area between each pair of transversely adjacent columns 22 with two such truss formations 30 being located between the fore and aft pairs of columns 22. As illustrated in FIG. 4, each truss formation 30 includes beams 32 inclined from the interior edges of the hulls toward one another for connection to the lowerdeck 18 of platform P and a transverse horizontal cross beam 34 joining the upper inner sides of hulls 12 one to the other. Additional vertically extending support members 35 also structurally interconnect hulls 12 and platform P. The truss formations 20 and 30 reinforce the structural relationship of the hulls, platform and columns and restrain, particularly by means of the cross beams 28 and 32, the hulls 12 against lateral displacement relative to one another.

As discussed more fully hereinafter, the support structure also includes stabilizing columns 22 which extend upwardly from the upper surfaces of hulls 12 to platform P a predetermined height, preferably greater than the maximum anticipated wave height(i.e., the vertical distance between wave crest and trough). In the preferred embodiment, four pairs of columns 22 are equally longitudinally spaced one from the other along hulls 12 with the column arrangement on each hull being symmetrical with respect to the column arrangement on the other hull. As shown in FIG. 3, each column 22 is generally oblong in shape and is arranged such that the long axis of its cross section lies parallel to the longitudinal centerline of the barge. Each column 22, as illustrated in FIG. 3, has longitudinally transversely spaced inner and outer vertical sides and semi-cylindrical fore and aft vertical end sections 36. The columns, however, may have circular, square, octagonal, elliptical or other horizontal cross-sectional configurations and need not have equal cross-sectional areas as illustrated herein. Symmetry of the cross-sectional areas of the columns about the pitch and roll axis of the barge is preferred.

However, it is important that each column 22 have a constant cross-sectional area at least for the intermediate portion of the column which extends vertically from a point located 0.25 of the total column height above the hulls 12 to a point located 0.75 of the total column height above the hulls (the latter point being 0.25 of the total column height below the platform P). That is, the middle half of each column 22 is constant in cross-sectional area; preferably, the columns 22 are constant in cross-sectional area throughout their entire length, but either or both the upper and lower ends of the columns may have different cross sections, for example, to facilitate structural connection between the columns 22 and the hulls 12 and platform P providing such different cross sections are of a configuration which do not adversely affect the operating characteristics of the barge when in high draft semi-submerged condition for pipelaying as amplified hereinafter. Preferably, the columns are located along the outboard sides of hulls 12 such that the outboard vertical sides of the columns 22 form vertical extensions of the outboard sides of the hulls, as illustrated in FIGS. 3 and 4. The centroids of the cross section of the columns are also preferably located outboard of the centerline of each hull 12 and thus in the high draft semi-submerged condition of the barge provide increased moment of inertia of the water plane areas about the roll axis affording improved stability characteristics about the roll axis, particularly for a barge of the present type which has a high length to width ratio as set forth hereinafter. While four pairs of columns are illustrated, it is possible to use at least three pairs of columns or more than four pairs of columns, depending upon the desired stability and motion characteristics and other design parameters; three pairs of columns are minimum for such a pipelaying barge.

Referring now particularly to FIG. 2, a pipeline assembly ramp 40 is disposed along one side of platform P and extends generally horizontally along the forward portion of the barge while declining along the aft portion of the barge as indicated at 41 (see FIG. 1) such that the ramp terminates substantially at the stern of the barge at an elevation corresponding substantially to the elevation of the second deck 18 of platform P. At the forward end of ramp 40 there is provided a pipe section line-up station 42 for receiving pipe sections from a transverse conveyor 44 which, in turn, receives pipe sections from a longitudinal conveyor 46 which extends longitudinally parallel to ramp 40 along the inboard side thereof. Sections of pipe are stored in discrete longitudinally aligned pipe storage areas 48, a plurality of such pipe storage areas 48 being spaced longitudinally along the opposite side of barge 10 from ramp 40 and also spaced along the longitudinal centerline of the barge. a plurality of pipe support means 50 including pipe rollers are longitudinally spaced one from the other along ramp 40 for support and movement of the pipe sections and pipeline to be laid. Between such pipe support stations are a plurality of welding stations 51 for successively welding by any suitable known means the joints between longitudinally aligned pipe sections as the pipeline is payed out from the barge. Further along ramp 40, there is provided a plurality of longitudinally spaced tensioners 52 each comprising upper and lower caterpillar-type treads, rolls or equivalent means which engage and grip the pipe to maintain a predetermined tension on the pipeline as it is payed out from the barge (in a manner known in this industry). Additional welding stations are located between each longitudinally adjacent tensioner 52 and a final welding station is located just aft of the furthest aft tensioner 52. A plurality of additional pipeline supports 54 are longitudinally spaced along declining ramp 41 aft of the tensioners 52. The pipeline supports 50 on the forward part of the barge are preferably arranged vertically so that the pipeline section carried by these supports lies along a substantially straight line slightly upwardly inclined (in direction toward the bow of the barge), at a suitable angle, e.g. on the order of two degrees. A plurality of aft pipeline supports 55 are arranged to support the pipeline section there along a curve forming an initial portion of the pipeline overbend where the pipeline curves downwardly for entry into the water. Additional pipeline work stations are spaced between tensioners 52 and supports 54 and include X-ray and dope stations.

A helideck 56 is located at the forward end of the barge and overlies the transverse conveyor 44, the forward end of the longitudinal conveyor 46, and the pipe line-up station 42. Also illustrated in FIG. 2 is a pair of anchor winches 57, which form part of an anchoring system, including additional anchor winches, not shown, located adjacent the stern portions of the barge. In a preferred form, the anchoring system includes 10 anchors and associated anchor lines, winches and other ancillary equipment; and, as discussed more fully below, such anchoring system enables three anchors to be set off each bow quarter and two anchors off each stern quarter.

Along the side of the vessel opposite pipe laying ramp 40, there is provided a gantry crane, generally designated 60. Transversely spaced tracks 62 are provided along platform P, and these tracks extend longitudinally substantially the entire length of the vessel platform P, and thus substantially the entire length of barge 10, as illustrated particularly in FIG. 2. Gantry crane 60 includes a pair of transversely spaced support trusses or legs 64, each being mounted on a pair of longitudinally aligned trucks 66 at each of its forward and aft extremities. Trucks 66 are engageable with the rails 62 and gantry crane 60 is thus movable longitudinally along tracks 62 over substantially the entire length of the platform P and barge and at least between longitudinal positions adjacent each of the end columns 22. Gentry crane 60 also includes a rotatable cab 68, supported by trusses 64 and trucks 66, at the upper end of trusses 66, and cab 68 carries a crane boom 70 for rotating movement with the cab about a substantially vertical axis by operation of power means, not shown. Gantry crane 60 is movable by suitable motors, not shown, along tracks 62 to selected longitudinal positions along barge 10 to perform lifting operations at such longitudinal positions including the transfer of pipe sections from supply boats to either the pipe storage areas 48 along platform P or directly to the pipe transfer and line-up equipment 44 and 46 for loading pipe sections directly into the pipe assembly line. Gantry crane 60 is also useful for lifting operations in connection with the stinger or other pipe transition element generally designated T in FIG. 1 and described below and for general purpose lifting, transferring and setting of loads about the barge. More particularly, the cab of gantry crane 60 is rotatable such that boom 7 overlies the barge or the one side of the barge along which the gantry crane is mounted for lifting operations off such one vessel side and off either end of the barge, depending upon the longitudinal location of the gantry crane along the barge. Gantry crane trusses 64 straddle the pipe storage areas 48 along the one side of the barge. Thus longitudinal movement substantially the entire length of the barge is not inhibited by the pipe sections stored in pipe storage areas 48 and increased deck load and storage capacity for the pipe sections are thereby achieved without impairing operation and use of the crane at any longitudinal position along the barge. The gantry crane 60 can be located adjacent the stern end of the platform P with the gantry trucks 66 locked to fix the gantry crane 60 at such position and gantry crane 60 is a heavy duty crane of such size and capacity with cab rotatable about a substantially vertical axis with boom 70 which is of such length and capacity whereby gantry crane 60 is capable of performing lifting operations for heavy loads off the end of the barge adjacent which the gantry crane 60 is thus mounted and also off at least the beam of the barge along which the gantry crane 60 is thus mounted. This would be done for example to service the transition segment T extending from the stern of the barge 10.

As seen in FIG. 6, hulls 12 are each divided into longitudinally and transversely spaced compartments 76 forming a plurality of ballast chambers for submerging and refloating the barge; any suitable number of compartments 76 may be provided as desired to perform the intended ballasting function. While only the starboard hull and ballast system for same is illustrated in FIG. 6, it will be understood that the port hull is similarly arranged and ballasted but on the opposite hand. Ballast chambers 76 are selectively and independently ballasted and deballasted whereby the hulls and lower portions of the columns may be submerged with platform P remaining substantially level throughout the sumbergence thereof and any attitude deviation of the barge in both heel and trim may be corrected during change of draft between low and high draft conditions and retention of the vessel in the high draft condition. Ballast chambers 76 may also be selectively and independently or dependently ballasted and deballasted when the barge is in high draft semi-submerged pipelaying condition as described below to provide a change in attitude of the barge about its trim axis and thereby satisfactorily proceed with pipelaying operations, particularly in conjunction and correlation with gantry crane operations as below described. To these ends, a plurality of conduits 77 extend from a pump room PR in each of the hulls 12 in opposite longitudinal directions to the several ballast compartments 76, there being multiple compartments in the forward and aft portions, respectively, of each hull. Pump room PR is provided with a sea suction inlet indicated at 78 and an overboard discharge indicated at 79 controlled by suitable power operated gate valves 80 and 81 respectively, the hull side being indicated by the dashed lines in FIG. 6. A pair of pumps 82 and 83 are connected in parallel via lines 84 and 85, respectively, across conduits 86 and 87, conduit 86 connecting with inlet 78 and conduit 87 connecting with discharge 79. Conduits 86 and 87 connect with a conduit 88 and it will be seen that, with valves 89 and 90 closed, pumps 82 and 83 suction sea water through inlet 78 past suitable valves 91 located in the parallel pump lines 84 and 85, and into conduit 87 which, with valves 81 closed, communicates with the main ballast conduits 92 which are connected in parallel with ballast compartments 76 through a pair of power operated valves 93 located on opposite sides of feed conduit 87, ballast conduits 77 each having a suitable power operated valve 94. Thus, with valves 80, 91, 93 and 94 open and valves 81 and 90 closed, the ballast compartments may be simultaneously ballasted with sea water at an equal rate to maintain the platform substantially level when the hulls and column portions are being submerged or the valves 94 may be selectively operated to control the ballasting of the individual compartments 76 whereby the trim and/or heel of the vessel may be corrected or altered during submergence or raising of the vessel and especially in the semisubmerged high draft condition during pipelaying operations, and particularly in correlation to and adjustment of longitudinal movement, location and/or load of the crane 60 as hereinafter described. Line 88 is used to transfer ballast between one hull and the other.

Opposite ends of conduit 86 connect conduits 92 through suitable power operated valves 90 with the pumps 82 and 83 suctions. The pumps 82 and 83 discharges are connected through valves 81 to the overboard discharge to 79.

To alter the draft of the barge from its high draft condition to the low draft condition with the hulls 12 having freeboard *f*, valves 80 and 93 are closed and valves 81, 90 and 91 are open. Pumps 82 and 83 operate a pump water in the same direction as before, and accordingly, suction from conduits 92 via conduit 86 thereby suctioning ballast conduits 77 through valves 94 withdrawing ballast water from compartments 76 via conduits 77, 92 and 86, the pump lines 84 and 85, open valve 81 and outlet 79. With appropriate valves 94 open, compartments 76 may be deballasted as required to return the barge to its low draft condition whereby the means waterline with respect to hulls 12 is located along a line shown at *f* in FIGS. 1 and 7 so that hulls 12 have freeboard above *f* in this low draft floating condition. Selected operation of valves 94 with valves 81 and 90 open and valve 80 closed deballasts selected compartments 76 are desired to alter the attitude of the vessel about the heel and/or trim axis as necessary or desirable and particularly to enable successful pipelaying operations as hereinafter described. It is thus readily seen that compartments 76 may be simultaneously ballasted and deballasted or selectively ballasted and deballasted or have ballast transferred between the port and starboard hulls by selected operation of the various valves and that this can be accomplished when the barge is in any operating draft, for example, in low draft floating condition with the hulls having freeboard (i.e., means waterline at about *f* in FIGS. 1 and 7), semisubmerged high draft floating condition, or any other intermediate draft condition during barge operations, whereby the attitude to the barge about heel and trim axis can be altered in such different draft conditions. Note also that the various valves, conduits, etc. of the foregoing ballast system are provided for each hull 12 whereby one or both hulls may be ballasted or deballasted alone or together or ballast transferred from one hull to the other.

In the disclosed and described embodiment of the present invention, the barge has an overall length of 400 feet at hulls 12, with each hull having a beam of 34 feet, a height of 20 feet and an inside spacing of 38 feet one from the other, thus providing an overall hull beam of 106 feet between outer sides of the two hulls 12. Thus, this embodiment has a length to width ratio of about 4 to 1 and should have a length to width ratio of at least 2.5 to 1. The height of the columns 22 is 23 feet. The centroids of the columns are equally spaced 39 feet from the vessel's longitudinal centerline. The pairs of columns are longitudinally spaced one from the other 63.25 feet with the bow pair of columns being spaced 19.75 feet from the forward extremities of the hulls 12. The length of each column is 46 feet and its width is 28 feet with the ends thereof being formed cylindrical in shape providing an overall column area of approximately 1119.5 square feet per column. The light ship displacement of the vessel in low draft condition is approximately 10,000 tons while the loaded displacement is high draft condition is approximately 21,800 tons. The weight of the gantry crane 60 may approximate 400 tons unloaded and has a capacity for lifting heavy loads on the order of 80 tons.

The pipeline transition segment T is releasably secured to the stern of barge 10 by a pivotal connection 74 and serves to support the "air length" portion of pipeline "payed out" from the barge and extending between the stern of the barge and the waterline pluse a portion of the pipeline extending below the waterline. The pipeline transition segment T may comprise one or the other of the "stingers" shown and described in aforementioned U.S. Pat. Nos. 3,704,596 and 3,685,305 the disclosures of which patents are incorporated herein by reference as though fully set forth herein.

Briefly, the disclosed pipeline transition segment T is a column stabilized variable draft type stinger which includes a generally triangularly or rectangular shaped base or hull structure generally designated 100 including a pair of transversely pontoons 101 and a depending keel 102, pontoons 101 and keel 102 being arranged in triangular or rectangular cross section and connected by suitable webs 103. The forward end of hull 100 includes laterally spaced hinges 104 which cooperate with hinge structure carried at the stern of the barge hull underlying the pipeline ramp whereby pipeline transition segment T is pivotally secured to barge 10. Pipeline transition segment T also includes a plurality of upstanding stabilizing columns 105 secured to each of the upper pontoons 101, the columns 105 being arranged in longitudinally spaced pairs. A plurality of pipeline supporting carriages, not shown, are mounted between the pairs of columns 105 and include rollers disposed in a fore and aft direction along the arc of the curve the pipeline will take in the overbend region and enable translational movement of the pipeline relative to the transition segment T. Referring to FIGS. 1, and 11—D and 12A–C, the pipeline transition segment T thus supports the pipeline schematically shown at PL as it is payed out from the barge in a manner such that the radius of curvature of th pipeline portion indicated at PLC in said Figures is always greater than the radius or curvature which would cause bending stresses exceeding maximum allowable bending stresses for the pipeline and/or the protective coating generally applied to such pipeline. The pontoons 101 are compartmented to form a plurality of ballast chambers which can be independently and dependently ballasted and deballasted from the barge 10. The pipeline transition segment T thus has the ballast capability to alter its draft between a low draft pontoon supported condition and a high draft semi-submerged floating condition wherein the waterline lies intermediate or above the height of columns 105 and also to change the attitude of the pipeline transition segment T about trim and heel axes by ballasting and/or deballasting selected compartments in the pontoons 101.

Turning now to the embodiment of the pipelaying barge illustrated in FIGS. 7–10, the basic construction and configuration is like that of the previously described pipelaying barge of FIGS. 1–6, but with several changes including: an increase in vessel beam to provide increased deck-load capacity, on the order of three times more deckload capacity; an increase in the depth of the hulls and columns to provide the necessary hydrostatic characteristics for such deckload; and modification to assemble and weld the pipeline along the centerline of the barge rather than along a side, thus enabling use of symmetrical transition element T'(-shown in FIG. 10 for this embodiment) and minimizing effects of vessel roll on the pipeline PL. Furthermore, this pipelayer barge embodiment with centerline pipelaying feature also includes an inclined ramp so that the angle of entry of the piepline into the water is improved and the "air gap" segment of pipeline between the barge stern and water line is much smaller thus enabling use of a smaller and sometimes a simpler pipeline transition segment T' than would otherwise be necessary. Other differences as between this and the previously described pipelaying barge embodiment will become apparent from the following description of this second embodiment.

Referring now to FIG. 7, barge 110 includes a pair of transversely spaced elongated hulls 12 extending in spaced parallel relation and providing sufficient displacement to support barge 110 in the low draft floating condition with the hulls having freeboard whereby the mean water line is along line *f* indicated in FIG. 7. As in the previous embodiment of FIGS. 1–6, the bow of each hull 112 is streamlined to reduce resistance to towing when barge 110 is entirely supported in low draft condition on hulls 112. Each hull 112 is substantially rectangular in cross section, as particularly illustrated in FIG. 9, although the edges of the hulls can be rounded and the sides arcuate and the hulls otherwise specifically shaped as previously described with respect to the prior embodiment of FIGS. 1–6. The hulls 112 each have top and bottom substantially parallel and substantially planar surfaces extending substantially the entire length of the hulls for reasons noted hereinafter.

A platform P′ comprising a main deck 114 and a lower deck 116 is supported a predetermined height above hulls 112 by support structure including a plurality of longitudinally spaced, transversely extending truss formations generally indicated 118 and a plurality of longitudinally spaced pairs of transversely spaced stabilizing columns 120. A truss formation 118 is longitudinally spaced between each longitudinally spaced pair of columns 120 and the truss formation between the longitudinally spaced pairs of columns is similar to the truss formation previously described in the prior embodiment with respect to FIG. 5. As illustrated in FIG. 9, additional transverse truss formations 122 are located in the areas between the hulls in transverse alignment with the longitudinally spaced pairs of columns 120. This latter truss formation is similar to the truss arrangement illustrated in FIG. 4. Both truss formations in this embodiment (as in that of FIGS. 106) also include horizontally transversely extending cross braces joining the upper inner sides of hulls 112, one to the other, to reinforce the structural relationship of the hulls, platform and columns, and to restrain the hulls against lateral displacement.

As in the previous embodiment, the support structure also includes stabilizing columns 120 extending upwardly from the upper surfaces of hulls 112 to platform P′ an effective height which may be equal to and preferably greater than the maximum anticipated wave height, i.e. the vertical distance between wave crest and trough. In this embodiment, four pairs of columns 120 are equally longitudinally spaced one from the other along hulls 112 with the column arrangement on each hull being symmetrical with respect to the other hull. However, at least three pairs of such columns or more than four pairs of such columns, longitudinally spaced one from the other, may be utilized, with three such pairs of columns being considered the minimum, as discussed above with reference to the embodiment of FIGS. 1–6. As shown by the dashed lines in FIG. 8, columns 120 are preferably generally oblong shaped with longitudinally elongated vertical sides and semicylindrical fore and aft vertical end sections. However, as discussed with reference to the embodiment of FIGS. 1–6, such columns 120 may have circular, square, octagonal or other cross-sectional configurations. Columns 120 should be constant in cross-sectional area for that portion of their height which extends from a point located 0.25 of the column height above the top of each hull 112 to a point located 0.75 of the column height above said hulls (or 0.25 of the column height from the bottom of the platform P′). Also, as discussed for the embodiment of FIGS. 1–6, columns 120 preferably have constant cross-sectional area throughout their height, but the section of the columns at the connections between the lower and upper ends of the columns with the hulls and platform respectively may be varied to provide for mechanical and structural interconnection providing such different cross section does not have an adverse effect on the hydrostatic and other operating characteristics of the barge.

This embodiment of pipelay barge 110 is provided with a pipelaying ramp 136 substantially along the longitudinal centerline of the barge, along which a pipe assembly line generally designated 138 is provided. Pipe storage areas 142 are disposed at various longitudinally spaced locations along each of the opposite sides of the barge 110 on opposite sides of pipe assembly line 138 and pipe sections may be transferred from the pipe storage areas 142 onto longitudinally extending conveyors 144 which flank the pipe assembly line 138 and which conveyors 144 and adapted to transport the pipe sections forwardly to pipe transfer and line-up equipment 146 located at the forward end of pipe assembly line 138. The pipe transfer equipment 146 includes transverse conveyors for transferring pipe sections from the longitudinal conveyors 144 transversely of the barge into alignment with the pipe assembly line 138 and the pipeline extending longitudinally therealong and generally along the longitudinal centerline of the barge. The pipe transfer conveyor 146 and the forward end of the pipe assembly line 138 is carried on a cantilevered extension of platform P′ which projects forwardly from the bow of the barge (see FIGS. 7 and 8). This cantilever extension also includes a helideck 160 spaced above the pipe transfer and alignment equipment 146. A plurality of longitudinally spaced welding stations 147 are located along pipe assembly line 138 and additionally between longitudinally adjacent pairs of pipe tensioners 148; any known suitable welding system may be used at such station. Additionally, dope and X-ray stations are located aft of the aftmost pipe tensioner 148. As will be appreciated from a review of FIGS. 7 and 8, the ramp 136 includes a forward portion 150 of main deck 114 and an elongated central well 152. The lower surface 154 or well 152 inclines downwardly and in an aft direction and provides a support surface for mounting the tensioners 148. The well 152 communicates at the aft end of the barge with a tunnel 156 which exits from the barge between the aft pair of columns 120 and enables the pipeline PL to be discharged from the barge at an elevation much closer to the waterline than possible with prior embodiments such as that of FIGS. 1–6. Dope, X-ray, and final coating stations are carried by a deck 158 which, in part, defines part of tunnel 156. As in the embodiment of FIGS. 1–6, various pipe support means with rollers (nnt shown) are spaced longitudinally along the ramp, with the pipe support means located on the barge forwardly of the tensioners supporting the pipe along a generally straight line while the pipe support means located on the barge aft of the tensioners 148 support the pipe along a generally downwardly curved line. Also, as in the prior embodiment, the slope of the straight portion of the pipeline is adjustable by adjustment of the elevation of the rollers, not shown, at each of the pipe support means and preferably the straight portion of the pipeline is inclined upwardly towards t he bow of the barge at a desired angle, namely, about 3.5° from horizontal (see angle B in FIG. 7) to provide a good angle of entry of the pipeline PL into the water including a good pipeline curvature at pipeline segment PLC.

In this embodiment, a pair of gantry cranes 162 and 164 are mounted for longitudinal movement along opposite sides of barge 110 on pairs of transversely spaced rails or tracks 166 which extend substantially the entire length of the platform P′ and barge 110. Gantry cranes 162 and 164 of this embodiment are each similar to gantry crane 60 of the previously described embodiment of FIGS. 1–6; each such crane includes lower transversely spaced longitudinally extending trusses 168 which support a crane base or pedestal 170, the lower ends of the side trusses 168 being supported on gantry crane trucks 172 which engage tracks 166. Each gantry crane 162 and 164 includes a cab 174 rotatable on base 170 about a generally vertical axis and carrying a boom 176. Referring especially to FIG. 9, as in the gantry crane 60 of the embodiment of FIGS. 1–6, each pair of crane side trusses 168 are transversely spaced one from the other such that the side trusses straddle the pipe storage areas 142 longitudinally spaced along each of the opposite sides of the barge enabling longitudinal movement of crane 162 and 164 along tracks 166 for location at substantially any longitudinal position along barge 100. It will be appreciated that each gantry crane 162 and 164 has sufficient capacity and a boom of sufficient outreach to perform lifting operations outboard of the side of the barge on which the gantry crane is mounted, as well as off either end of the barge depending upon the longitudinal location of the crane along the barge. As in the prior embodiment, the cranes are utilized for lifting operations of one side and either end of the barge including the transfer of pipe sections from supply boats onto the storage areas 142 or directly onto the longitudinal conveyors 144 and for general purpose lifting operations aboard the barge.

Each gantry crane 160 can be located adjacent the stern end of the platform P′ with the gantry trucks 166 locked to fix either gantry crane 160 at such position, and each gantry crane 160 is a heavy duty crane of such size and capacity with cab rotatable about a substantially vertical axis and with boom 176 which is of sufficient length and capacity whereby such gantry crane 160 is capable of performing lifting operations for heavy loads off the end of the barge adjacent which such gantry crane 160 is thus mounted and also off at least the beam of the barge along which such gantry crane 160 is thus mounted. This would be done for example to service the transition segment or stinger T′ extending from the stern of the barge 110.

The hulls 112 of this embodiment of FIGS. 7–10 are compartmented and ballasted and deballasted similarly as described above with respect to embodiment of FIGS. 1–6. It is believed sufficient to summarize here that such ballast system has the capability to ballast the barge 110 between low draft floating condition with hulls having freeboard and semi-submerged high draft operating condition and can selectively ballast and/or deballast any part of such ballast system to alter the attitude of the barge about trim and heel axes as desired and for the purposes set forth herein.

In a suitable pipelaying barge embodiment per FIGS. 7–10, the barage can have an overall length of 460 feet at hulls 112, with each hull having a beam of 40 feet, a height of 23 feet and an inside spacing of 50 feet one from the other providing an overall hull beam of 130 feet between the outer sides of hulls 112. The height of the columns 122 is 25 feet so that the height from keel to the underside of the platform is 48 feet. In this embodiment, the barge has a length to width ratio slightly less than 40 to 1 and should have a length to width ratio of at least 2.5 to 1. The centroids of the columns 122 are equally spaced 50 feet from the vessel's longitudinal centerline. The pairs of columns are longitudinally spaced one from the other 128 feet with the bow pair of columns being spaced 38 feet from the forward extremities of the hulls 112. The length of each column is 50 feet and its width is 30 feet with the ends thereof being formed cylindrical in shape providing an overall column area of approximately square feet per column. The light ship displacement of the vessel in low draft condition is approximately 12,000 tons while the loaded displacement in high draft condition is approximately 30,000 tons. The weight of each gantry crane 162 and 164 may be approximately 400 tons and has a capacity for lifting loads up to about 80 tons. The GM of this barge is about 4 feet.

The pipeline transition segment T′ may be column-stabilized stinger of such type as disclosed in U.S. Pat. No. 3,685,305 and particularly with respect to FIGS. 11–13 thereof, with the transition segment or stinger T′ being pivotally hinged to the stern of both hulls 112 as illustrated in FIG. 10 hereof. Further description of the particular transition segment or stinger T′ is not believed necessary; it is sufficient to note that such transition segment or stinger T′includes a hull having a plurality of longitudinally and transversely spaced ballast compartments which can be selectively ballasted and deballasted to alter the draft of the pipeline transition segment between high and low draft conditions, and also to alter the attitude of the pipeline transition segment T′ about heel and trim axes as desirable and especially in trim to control the curvature of pipeline segment PLC within desired limits.

For lifting, transferring and setting loads, in both embodiments of the pipelay barge hereof, crawler-type cranes without rails fixed to the platform may be utlized in lieu of gantry type cranes. Each crawler crane would include a rotatable cab and boom operable similarly as described above with respect to the gantry crane in conjunction with the below described constructional and operational features of the semi-submerged pipelaying vessels including correlation of ballast with crane movement, location and/or load which is applicable to both types of cranes when used in analogous manner.

In use, the pipelaying barge hereof is moved (by means not shown) in a low draft floating condition with the hulls having mean water line at *f* so the hulls have freeboard and can be efficiently moved at speeds on the order of 8 to 10 knots providing the present vessel with high mobility for transit between work sites located in different distant locations of the world. The barge can be efficiently towed by available tugs; or it can be provided with propulsion machinery whereby it can move from site to site under its own power, if desired. At the work site, the pipeline transition segment is coupled to the pipelaying barge by the described hinge connection, the transition segment being generally towed or transported to the work site by a separate vessel. In this connection, the crane or cranes on the pipelaying barge are located adjacent the stern end of the barge to connect the barge and pipeline transition segment and/or otherwise service the latter.

At the work site, the ballast compartments of the barge 10 (or 110) and in the pipeline transition segment T (or T′) are simultaneously ballasted to submerge their respective hulls and pontoons. The barge 10 (or 110) is ballasted so that the columns of the barge are submerged at least 0.25 the height of the columns above the hull tops, and preferably about 0.5 the height of the columns.

Referring to FIG. 13, that is a graph showing the permissible range of distance between the top of the twin hulls 12 (or 112) of the pipelaying vessel 10 (or 110) and the mean water line at "load line draft" of the pipelaying vessel in semi-submerged floating condition dependent on varying column height, for construction and use of pipelaying barges utilizing the present invention. Load line draft is the maximum permissible high draft position for such a pipelaying vessel, and FIG. 13 shows along the ordinate the distance from the top surface of the hulls 12 (or 112) to the mean waterline constituting permissible load line draft for pipe laying vessels 10 (or 110) having different heights of columns 20 (or 120) shown along the abscissa. An envelope bounded by maximum and minimum curves designated A and B constitutes the range in load line draft condition with respect to given different column heights varying between a minimum column height of about 20 feet and a maximum column height of up to about 80 feet. The optimum operating draft for a given height column is also illustrated by the curve designated at C within the maximum and minimum envelope curves A and B. The location of the mean water line above the vessel hulls 12 (or 112) and in relation to the height of the columns 20 (or 120) is determined according to the foregoing for the pipelaying barge 10 (or 110) when it is in semi-submerged high draft floating condition for pipe laying operations. As further amplified below, the columns of the pipeline transition segment or stinger T (or T′) are thus submerged according to extent of submergence of columns of the barge 10 (or 110). Additionally, the pipeline transition segment T (or T′) is ballasted to establish its own trim angle to a desired angle suitable for laying pipe of given size in the specified depth of water with a predetermined configuration of curved pipeline section PLC.

For most pipelaying operations, the trim of the barge 10 (or 110) is set a predetermined trim angle to improve the angle of entry of the pipeline into the water; and usually the barge 10 (or 110) will be ballasted to provide a preset operational barge trim angle within a range from 0 to 2.5 degrees from horizontal, and preferably about 1.5 degrees, with the bow end of the barge tilted upward. When the barge 10 (or 110) is in semi-submerged column stabilized condition, with the mean waterline above the hulls as herein described, such columns provide righting moments about pitch and roll axes to provide requisite barge stability consistent with requisite motion-minimizing characteristics also. Particularly, the barge 10 (or 110) has a construction such that the configuration and area of the columns and the number or columns, and distances of the columns from the longitudinal and transverse centerlines of the barge are such to provide greater righting moment about the barge's transverse pitch axis than the righting moment about the barge's longitudinal roll axis when the barge is in high draft semisubmerged pipelaying condition. The substantially parallel planar top and bottom surfaces of the hulls as above described provide mass damping when the barge is in high draft column stabilized condition; this inhibits vertical motion of the barge in heave, and also inhibits net vertical displacement of the ends of the barge due to angular motion in pitch. Still further, when the barge 10 (or 110) is in the high draft condition, the wave action is only against the columns and the trusses and the barge thus achieves substantial transparency to wind and wave action. Further, minimized motion, with requisite stability for the barge and pipeline transition segment combination according to the foregoing embodiments, also is achieved by providing a low metacentric height ("GM"), for example about 4 feet.

With the barge 10 (or 110) disposed in semi-submerged high draft floating condition with mean waterline above twin hulls 12 (or 112) as above-discussed, the pipeline transition segment or stinger T (or T′) hinged to the stern will be ballasted and submerged also as above-noted. The column-stabilized stinger T (or T′) is ballasted to establish a suitable trim angle of the stinger T (or T′) at about 8°–10° from horzontal and tilted upwardly towards the barge as diagrammatically illustrated in FIGS. 11A to 11D and 12A to 12C. Most of the columns of the disclosed stinger T (or T′) will be submerged below water line, generally excepting only the first and possibly also the second pairs of stinger column(s) nearest the stern of the pipelaying barge. The geometrical construction of the stinger and location of its pipe supporting rollers or equivalent means plus the angle of trim of the stinger in relation to size, draft and trim of the barge will determine the curvature of the pipeline extending from the barge stern over the pipe supporting stinger into the water and also to the sea bed at a given water depth.

When in high draft column stabilized condition for pipe laying as above discussed, the natural period of the pipelay barge and stinger combination in roll is between about 25–30 seconds, in pitch about 20 seconds or more, and in heave about 16 seconds.

The motion responses of the pipelaying barge 10 (or 110) to wind and wave action are greatly minimized, especially with respect to change in attitude of the barge about its pitch axis as well as minimizing heave; this is important in pipe laying operations and specifically because the curvature of the pipeline segment PLC extending from the vessel is highly affected by and sensitive to even small changes in the pipelaying vessel's angular disposition about pitch and trim axes. Once the attitude of the pipelaying barge about the trim axis is preset as above discussed, static trims of such barge should be limited to less than plus or minus one-half degree for the disclosed pipe laying arrangement. Thus, the configuration, size and weight of the barge 10 (or 110) and its load distribution and especially the size, configuration, area, location and resultant righting moment of the columns about the pitch axis are designed in light of this severe limit of angular change of the pipelaying barge's attitude about the pitch axis.

To lay pipe when the barge is in the high draft column stabilized condition with preset operational trim, the pipe sections carried by the barge in the pipe storage areas are disposed onto the longitudinal and transverse conveyors for assembly and connection one with the other along the pipe assembly line. Particularly, the pipe sections are welded one to the other and the pipeline is payed out from the barge over the transition segment for entry into the water and final disposition on the sea bottom. The tensioners maintain a predetermined tension on the pipeline as it is payed out and this, in conjunction with the transition segment, maintains the pipeline curvature within allowable stress limits and at or greater than the minimum radius of curvature. To pay out the pipeline, the barge and transition segment are advanced along the track of the pipeline along the sea bottom by hauling in the forward anchor lines and paying out the aft anchor lines. In relatively shallow waters and using considerable lengths of anchor line, the barge can be advanced in this manner 3000 and 4000 feet before the anchors are retrieved by anchor boats and reset.

It will be appreciated that with the foregoing described column stabilized barge and transition segment arrangement, the pipeline is payed out from the aft end of the barge at an elevation substantially above the mean waterline, for example, on the order of 15–50 feet. The transition segment thus supports the pipeline as it is payed out from the barge for the air length of the pipeline between the barge and the mean waterline and also a section of the pipeline extending some distance in the water while maintaining the curvature of the pipeline extending from the tensioners on the barge within the permissible stress limits and radius of curvature.

As noted previously, the angle of trim of the barge in semi-submerged high draft condition is a significant factor in pipelaying operations as it affects the pipe curvature in the pipeline segment PLC extending from the aft end of the barge. The pipeline extending from the barge stern over the pipeline transition element into the water and to and on the sea bed is somewhat "S-shaped" whereby the pipeline first assumes a concave downward curve or "overbend" as it is payed out from the barge end and over the transition segment and then passes through a point of inflection at a location beyond the stinger and has an intermediate section which then extends to sea bottom and assumes a concave upward curve or "sagbend" as it is layed along the sea bottom. The pipeline is maintained as it is being laid within a suitable percentage of the stress yield point of the pipeline for a given pipe as the pipeline is stressed in passing through the overbend, "inflection point" and sagbend. For a given pipe, changes in the angular attitude of the barge about the trim axis beyond certain narrow limits will cause higher than allowable stresses which will break the concrete coating usually applied about the pipe which is unacceptable or will adversely overstress the pipe.

With respect to control of the attitude of the vessel in trim about the pitch axis, it is desirable to set a predetermined operational trim to improve the entry angle of the pipeline into the water and the attitude and curvature of the pipeline as it is payed out from the barge over the transition element and disposed along the sea bottom. As previously noted, a bow-up operational trim is preferably set by proper ballasting of the vessel prior to commencing pipelaying operations; and, depending upon the pipe size and water depth, a preset barge trim of 0 to 2.5 degrees, and preferably about 1.5 degrees, is set by ballasting the barge as aforedescribed to alter its attitude to such a bow-up trim angle. With such a preset trim angle of the barge, a preset initial inclination of the pipeline of up to 10° from horizontal, but preferably up to 6° from horizontal bow-upward may be used; the latter degree of pipeline inclination from horizontal is the resultant of inclination of the pipeline with respect to the barge plus angle of trim of the barge about its trim axis. With the barge in column stabilized semi-submerged condition for pipe laying, any change in attitude of the barge in trim should be maintained within an angle not is excess of plus or minus about one-half degree from the preset operational trim to avoid introducing a pipe curvature in the overbend which would introduce stresses and strains higher than allowable for the concrete coating about the pipe or for the pipe itself. That is, it is necessary to maintain the attitude of the vessel in trim during pipe laying operations within plus or minus about one-half degree of the preset operational trim which usually is within 0 to 2.5 degrees bow-up as discussed.

While the barge is designed to provide suitable righting moments about the pitch axis as determined by the configuration, number, areas and distances of the columns from the pitch axis, the geometry of the submerged hulls and lower column portions, plus the weight distribution of the barge, which would maintain the angle of inclination of the barge about the pitch axis within plus or minus one-half degree during operations and in response to dynamic forces, i.e. wind and wave action, the pipe laying operation onboard the barge can and will intorduce changes in the attitude of the barge in trim exceeding plus or minus one-half degree from the predetermined operational trim unless corrected. For example, it has been found that the type, weight and operation of crane or cranes used on the semi-submersible pipelaying barge of this invention and the necessary longitudinal movement of the cranes, either loaded or unloaded, introduces a significant change in the net moments about the pitch axis which will cause a change in the barge's sttitude about the trim axis exceeding plus or miuns about one-half degree from the preset operational trim. More particularly, it has been found that movement of a gantry crane 60 (or 160) longitudinally along the barge platform P a predetermined distance or greater will cause a significant change in the angle of trim of the barge when the barge is in high draft semisubmerged column stabilized pipelaying condition to such extent that if it were not compensated for the attitude of the barge about the trim axis would exceed plus or minus one-half degree of the present operational trim. For example, with a pipelaying barge of the size and configuration illustrated and discussed herein and mounting a gantry crane weighing on the order of 400 tons for carrying loads of about 80 tons, longitudinal movement of the crane approximately one-quarter of the length of the vessel causes a change in the angle of trim of about one-half degree. The movement of such a gantry crane longitudinally along the barge on either side of the pitch axis, and also across the pitch axis, and the crane location before and after such movement, even when the crane is unloaded, thus becomes a significant factor affecting maintenance of the requisite attitude of the barge about the trim axis within plus or minus one-half degree of the preset operational trim of the barge before such crane movement. To compensate for the change in the angle of trim caused by longitudinal movement of the crane along the platform and thereby maintain the angle of trim of the barge within the stated allowable small angle of change from the preset angle of trim existing prior to longitudinal movement of the crane, the barge 10 (or 110) is ballasted in response to and in correlation with longitudinal movement and location of the crane or cranes so that the angle of trim change induced by, during and after longitudinal movement of the crane with or without load does not exceed plus or minus one-half degree change from the preset angle of trim.

Figure 11A:
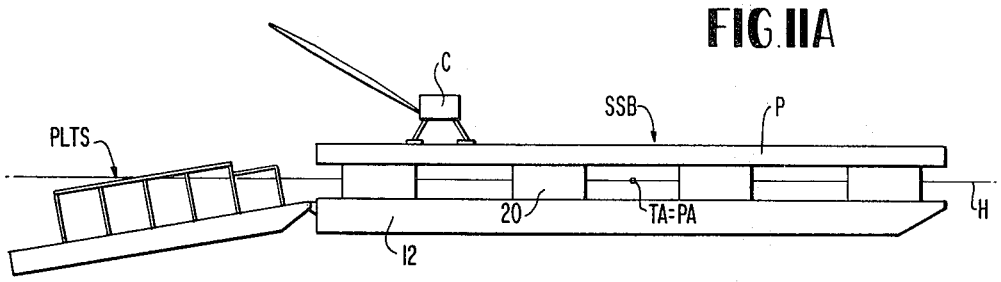
Figure 11B:
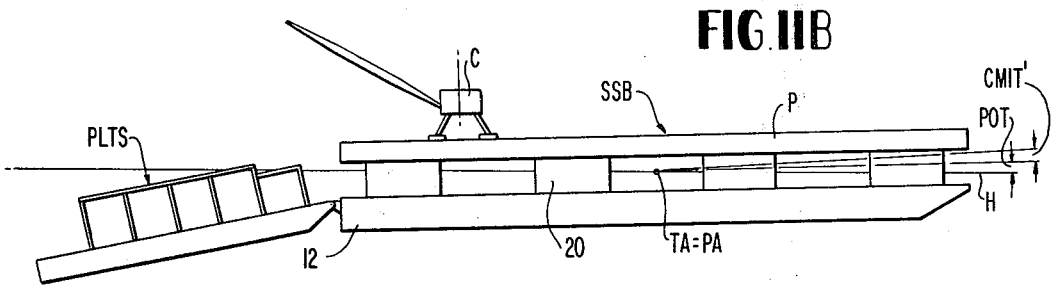
Figure 11C:
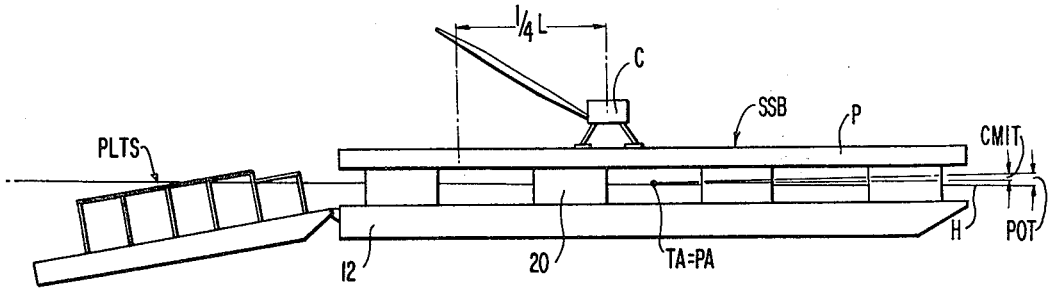
Figure 11D:
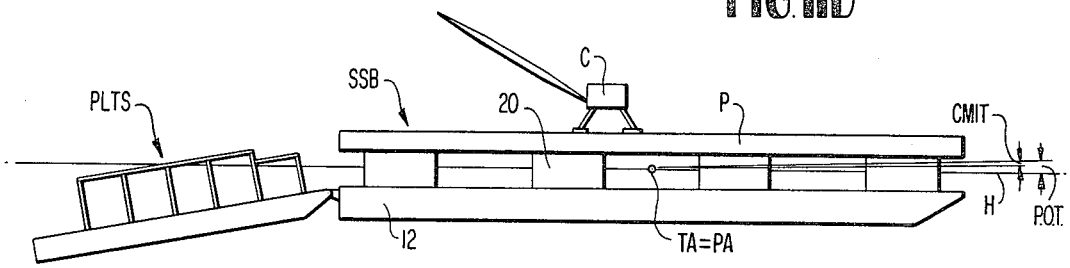

The foregoing is diagrammatically illustrated in FIGS. 11A–11D and FIGS. 12A–12C, in which drawings the angles and Figures discussed below are exaggerated for clarity. In FIG. 11A, the barge 10 (or 110) is illustrated in a horizontal position with 0 ° trim and a preset bow-up trim of 8–10° for the pipeline transition segment or stinger T, such attitudes of barge and stinger being accomplished by appropriate ballasting as previously discussed. Referring to FIG. 11B, for the purpose of providing a better angle of entry of the pipeline into the water and to improve the attitude and curvature of the pipeline being laid, the barge 10 (or 110) is set at an attitude having a bow-up preset operational trim angle of between 0° –2.5° , and preferably 1.5°; and this is accomplished by selective ballasting and/or deballasting of the hull compartments as above discussed. The transition segment is also ballasted to maintain its own desired trim angle relative to the barge and horizontal so as to maintain the pipeline segment POL within proper curvature limits during all pipe-laying operations. The discussed preset operational trim angle of the barge (for example 1.5 degrees) is designated P.O.T. in FIG. 11B which also illustrates a representative crane C located adjacent the aft end of the barge. Longitudinal movement of the crane C, either loaded or unloaded, from its position adjacent the aft end of the barge shown in FIG. 11B for a certain distance, for example approximately one-quarter of the length of the vessel, to a location closer to the pitch axis, but with the axis of rotation of the crane (designated by the dashed lines in FIGS. 11B and 11C) still located on the aft side of the pitch axis as illustrated in FIG. 11C, will induce a change in the angle of trim of the vessel in excess of one-half degree unless compensated for during movement of the crane. This is illustrated by the angle designated CMIT (i.e. "crane movement induced trim") in FIG. 11C, and in this instance the foregoing described crane movement causes a decrease in the previously set bow-up angle of trim POT which must be compensated for. Consequently, for longitudinal movement of the crane a distance which causes a change in the vessel's trim angle exceeding one-half degree change from the prior set trim angle, ballast correction of trim is necessary during and after the crane movement to counteract the resultant induced angle of trim change and maintain the attitude of the vessel close or equal to the preset operational trim, and in any event within plus or minus one-half degree of the preset operational trim angle. Consequently, the ballast system and crane movement are correlated one with the other such that the crane movement induced-angle of trim is offset or counteracted by ballasting. This is illustrated in FIG. 11D wherein the actual operating angle of trim of the vessel is illustrated or equal to the predetermined operating trim angle and in any event at least kept within plus or minus one-half degree of the preset operational trim before crane movement.

It will be appreciated from a review of FIGS. 11B and 11C that movement of the crane a like distance from the position just aft of the pitch axis illustrated in FIG. 11C to a location adjacent the aft end of the barge illustrated in FIG. 11B would cause a similar change in the angle of trim of the barge in the opposite direction. That is, if the preset operational trim is set with the crane located as illustrated in FIG. 11C, movement of the crane aft to a location as illustrated in FIG. 11B would increase the bow-up attitude of the vessel beyond the predetermined trim angle and exceeding one-half degree unless compensated for to counteract change in trim angle during crane movement as discussed. This is illustrated in FIG. 11B by the dashed lines and angle CMIT′. This crane movement induced trim change must be offset by ballast correction in the opposite direction in order to maintain the barge attitude about its trim axis within about one-half degree of the preset operating trim. Such ballast corrections can be and are performed simultaneously with movement of the crane or in increments upon movement of the crane short distances thus enabling the ballast system to catch up with and counter the change in moment distribution caused by crane movement and avoid the change in barge trim angle which would thereby result if not counteracted as discussed.

A similar type correction is necessary when the crane is similary longitudinally moved along the forward half of the barge, and also is the crane is moved similarly longitudinally fore and aft of the trim axis. Referring to FIGS. 12A–12C, the preset operational trim may be set with the crane located slightly aft of the pitch axis as illustrated in FIG. 12A. Movement of the crane forwardly to the position shown in FIG. 12B would change the attitude of the vessel in excess of one-half degree from the present operational trim (if not counteracted) in this case inducing a bow-down attitude designated CMIT in FIG. 12B with respect to the angle P.O.T. Consequently, ballast correction in trim is necessary during such crane movement to maintain the barge attitude within one-half degree of the angle P.O.T., and this is illustrated in FIG. 12C which shows ballast correction having been applied so that the crane movement induces a change in angle of trim after ballast correction, which angle is less than plus or minus 0.5° from the angle P.O.T., designated at CMIT in FIG. 12C.

Following is a particular discussion of important features of the novel column stabilized semi-submersible barge ("SSB") and pipelaying combination including pipeline transition segment ("PLTS") with reference being made to all drawings and description above, but with particular reference now made to FIGS. 14A and 14E (plus FIGS. 13 and 1 ) which show and identify particular features and terms defined and amplified in numbered sub-paragraphs immediately following:

1. The length of the barge SSB along the barge platform P is designated by "BLP", and along the barge hulls by "BLH". The width of the barge SSB across the platform P is designated by "BWP", and between the outside of the hulls by "BWH". The barge SSB is elongated whereby the ratio of "BLH" to BWH is at least 2.5 to 1 and preferably larger; and likewise for the ration of BLP to "BWP"

2. "CL" is total load of crane means C on the barge weight of crane with and without load);

3. "TA" and "PA" is the locus of trim axis and pitch axis of the barge SSB:

4. "LC" is the locus and distance of total crane means load CL in relation to barge trim axis TA at beginning, during and cessation of movement of said crane means C;

5. "CLM" is the resultant moment about the barge trim axis TA due to crane means load CL and its locus LC with respect to the barge trim axis according to 4. above — CLM varying in accordance with variation of LC and/or CL per 92), (3), and(4) above.

6. "BCMP" are the righting moments of the barge columns (12 or 120) about the axis TA (or PA) when the barge SSB is in semi-submerged high draft pipelaying operational condition and counteracting CLM per (5) above; and "BCMP" is the total of such righting moments produced by the effect of the waterplane area of each barge column (22 or 120) called "BCA" and the square of the distance of the centroid of each such barge column waterplane area BCA from the trim or pitch axis TA or PA, the latter distance being called "BCAL". The aforesaid BCMP is determined according to the following:

a. $BCMP = [\Sigma[BCA \times (BCAL)^2 \times K_1] + K_{2p}] \sin \theta$ wherein b. $K_1$ is a constant which is a function of the underwater geometry of the barge SSB (10 or 110); and c. $K_{2p}$ is a constant which is a function of the underwater geometry of the barge SSB, the moment of inertia of each column about the column's own axis "CTA" extending transversely of the barge SSB and the weight distribution within the vessel.

d. $\theta$ is the angle of inclination of barge SSB about the trim axis from the origingal equilibrium position (see FIG. 14C; angle $\theta$ is equal to "CMIT" discussed above).

7. If crane induced moment CLM per (5) above in typical operation of the crane means C over a fraction of the total possible crane means travel longitudinally of the barge SSB is such that CLM exceeds the value of BCMP for aforesaid angle $\theta$ equaling approximately 0.5° per (6) above, thus causing an angle of trim of barge SSB due to such crane induced moment CLM absent counteracting ballast per paragraph 8, 9, and 10 below (such angle without such correction being called "BATC") to be more than plus or minus about one-half degree change in barge trim angle as compared to the preset angle of trim "PAT" before said crane means movement per paragraphs (4) and (5) above.

Figure 14C:
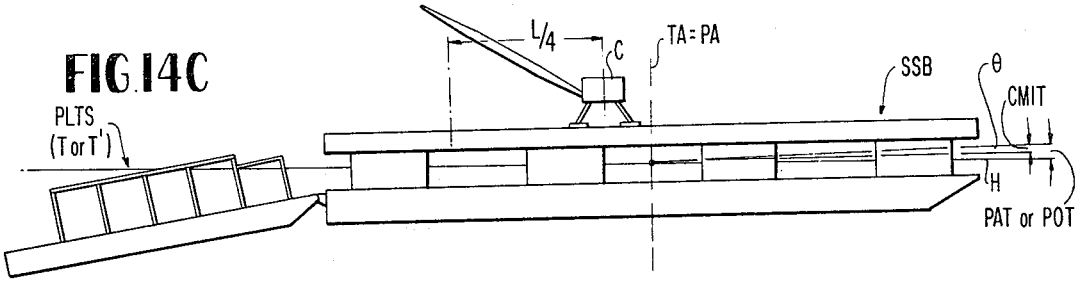
Figure 14D:
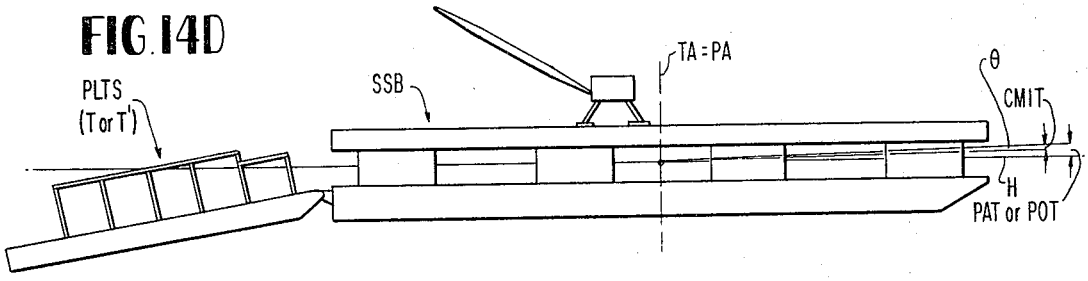

8. The described ballast means of barge SSB is operable in semi-submerged condition to change the angle of trim of said barge about TA and establish PAT at a desired angle, generally about 0.0° to 2.5°, and preferably about 1.5°, with respect to the horizontal before movement of said crane means C per (3), (4) and (5) above;

9. The ballast means of barge SSB is operable in semisubmerged condition between beginning and cessation of movement of said crane means per 94), (5), (6), and (7) above to limit the aforesaid angle BATC so that change in barge angle of trim "CMIT" defined above and shown in FIG. 14C is less than plus or minus about one-half degree variation from the preset barge angle of trim PAT.

10. "LCM" represents the limiting extent of longitudinal movement of crane means C and crane load CL in relation to barge platform length BLP which is possible without ballasting to counteract BATC whereas when LCM exceeds such limit said ballast means is operated to limit BATC and maintain CMIT within the limits stated in paragraph (9) above.

11. The barge SSB has columns (22 or 120) of such height "BCH" and the means for ballasting the barge SSB is operable to raise it to a low draft condition so that the twin hulls (12 or 112) have freeboard and also operable to ballast the vessel to semi-submerged hight draft pipelaying condition such that the defined and shown load line draft "LLD" of the barge SSB in relation to height of the barge columns BCH is within the limits of envelope curves A and B of FIG. 13 of this application and preferably is according to curve C of FIG. 13 of this application.

12. The minimum waterline above the top surfaces of the hulls when the barge is in high draft semi-submerged column stabilized operating condition is repersented by "MWLH" and is preferably equal to or greater than 0.25 the height of the barge columns BCH and at least 8 feet.

13 The pipeline transition segment. PLTS in the column stabilized semi-submerged operational condition of the barge SSB is adjusted about a transversely extending axis in relation to the attitude of the barge about its trim axis and to the horizontal such that the curvature of the pipeline extending from the barge end and over the pipeline transition segment PLTS is controlled so as not to exceed allowable stresses for the pipeline and its coating; such adjustment to segment PLTS is made in conjunction with and correlated to operation of the ballast means for maintaining the draft of the barge within the stated limits and also maintaining barge trim angle change CMIT less than plus or minus about one-half degree variation from the preset angle of trim PAT whereby the relative angular relation between the barge SSB and pipeline transition segment PLTS is substantially maintained throughout pipelaying operations so as not to exceed allowable stress for the pipeline and/or any coating which is applied to the pipeline.

14 Additional important features include:(a) hulls having non-streamlined top and bottom surfaces, for example, generally parallel planar top and bottom hull surfaces, extending throughout substantially the entire length of the hulls with each hull preferably having a generally rectangular cross-section with its longer axis extending in the direction of the transverse centerline of the barge, with permissible variations in the configurations of the hull sides as discussed previously, so as to provide increased mass resistance to movement of the hulls through water in a vertical direction when the barge lies in high draft column stabilized semi-submerged operating condition ; (b) a plurality of longitudinally spaced structural means reinforcing the structural relationship of the hulls, platform and columns with such structural means including substantially transversely extending members structurally interconnecting the hulls adjacent the uppermost portions of the hulls and restraining the hulls against lateral displacement relative to one another; (c) at least six columns interconnecting the hulls and platform with three columns upstanding from each hull and a pair of columns located adjacent each of the bow and stern ends of the barge, although one or more additional pairs of columns may be provided, with four pairs of columns being utilized in each embodiment of the disclosed barge; (d) also the area of the columns, the number thereof, and the distance of the columns from the longitudinal and transverse centerlines of the barge are such as to provide a greater righting moment about the pitch axis "BCMP" than the righting moment about the longitudinal roll axis "BCMR" when the barge is in semi-submerged high draft column stabilized operating condition; BCMR is determined similarly as above stated in paragraph (6) with respect to BCMP except that the distance of the centroid of each barge column waterplane area is measured from the roll axis RA (or heel axis HA) and the constant $K2_R$ is substituted for the constant $K2_P$ in the formula stated in paragraph 6(a) above wherein $K2_R$ is a constant which is a function of the underwater geometry of the barge, the moment of inertia of each column about the column's own axis extending longitudinally parallel to the longitudinal axis of the barge and the weight distribution within the barge; and (e) each column should be constant in cross-sectional area at least for the intermediate portion of the column which extends vertically from a point located 0.25 of the total column height above the hulls to a point located 0.75 of the total column height above the hulls (0.25 of the total column height below the platform).

It is noted that barge 10 and 110 include above discussed means for ballasting to change the attitude of the barge about its roll axis RA when that should be necessary or desirable.

It is noted that in prior column-stabilized twin hull semisubmersible derrick barges used for pipelaying utilizing the vessel arrangements disclosed in assignee's aforementioned U.S. Pats. Nos. 3,835,800, No. 3,686,305 and 3,704,596 (as discussed earlier in this application) all crane load during pipe laying operation is transferred to the vessel hulls adjacent the stern at the same locus; hence, there are no comparable conditions in such prior pipelaying vessels as changing LC of crane load CL, per above par (4) or change in CLM per above par (4), or changing CLM in relation to BCMP and counteraction of ballast for adjustment of BATC to maintain CMIT per above paragraph (5) through (10).

CLAIM TERM DEFINITIONS

The following designations are used in the claims hereafter in the claims hereafter in the same way as they are in paragraphs numbered (1) through (13) above with reference to the drawings [as stated in the paragraph preceding said numbered paragraphs (1) through (13)]:

a. BLP and BLH and BWP and BWH are defined in said numbered paragraph 1.
b. CL and C are defined in said numbered paragraph 2.
c. TA is defined in said numbered paragraph 3.
d. LC is defined in said numbered paragraph 4.
e. CLM is defined in said numbered paragraph 5.
f. BCMP and BCA and CTA and angle $\theta$ are defined in said numbered paragraph 6.
g. BATC and PAT and CMIT are defined in said numbered paragraphs 7 and 9.
h. BCH is the height of the barge's columns.
j. LLD is the load line draft which is set forth in FIG. 13 in relation to column height and shown in FIG. 14A.
k. PAT is the barge's preset angle of trim per paragraph 7 above and is provided by selective ballasting and/or deballasting the fore and aft ballast comparments as described above.

The invention may be embodied in other specific forms without departing from the spirit or essential characteristics thereof. The present embodiments are therefore to be considered in all respects as illustrative and not restrictive, the scope of the invention being indicated by the appended claim rather than by the foregoing description, and all changes which come within the meaning and range of equivalency of the claims are therefore to be embraced therein.

What is claimed and desired to be secured by United States Letters Patent is:

1. A method of operating a column stabilized semisubmersible pipelaying barge having a pair of elongated hulls disposed in spaced side by side relation, a working platform spaced above said hulls a predetermined height including a pipe assembly line for joining pipe sections one to the other in end to end relation, columns connected to and between said hulls and said platform and a crane movable longitudinally along the barge platform comprising steps of:

ballasting the barge to alter its draft between a low draft hull supported floating condition with the hulls having freeboard and a high draft semisubmerged column stabilized floating pipelaying operating condition;

ballasting said barge to preset said barge trim angle PAt between predetermined angular limits;

displacing said crane substantially longitudinally of the barge a distance along said platform such that total crane means load CL and its locus LC in relation to barge trim axis TA at beginning, during and cessation of movement of said crane means causes a resultant moment CLM about the barge trim axis TA of such magnitude whereby typical operation of said crane means over said distance along said platform causes a change in the angle BATC due to movement of said crane whereby BATC will exceed plus or minus about one-half degree from the preset angle of trim of the barge PAT before such movement of said crane if said moment CLM is not counteracted;

ballasting said barge between beginnig and cessation of movement of said crane said distance along said platform to maintain the barge angle of trim change CMIT less than plus or minus one-half degree variation from said preset barge trim angle PAT;

and ballasting the vessel in semi-submerged condition so that the load line draft of the barge LLD in relation to barge column height BCH is within the limits of envelope curves A and B of FIG. 13 of this application.

2. The method according to claim 1 including ballasting said barge to provide a load line draft LLD of the semi-submerged barge in relation to barge column height BCH according to curve C of FIG. 13 of this application.

3. The method according to claim 1 includng ballasting to establish a preset barge trim angle PAT of between about 0.0° to 2.5 ° from horizontal and bow up.

4. The method according to claim 1 wherein pipeline transition means are provided for supporting the pipeline extending from one end of the barge into the water, including establishing the angle of the pipeline transition means relative to horizontal and in relation to the draft of the barge and angular attitude of the barge about its trim axis so as to maintain curvature of the pipeline extending from said barge end and over said pipeline transition section so as not to exceed allowable stress for the pipeline and any coating on the pipeline.

5. The method according to claim 1 including establishing the barge angle of trim change CMIT less than plus or minus one-half degree variation from the barge's preset angle of trim PAT due to longitudinal movement of said crane means.

6. The method according to claim 1 performing lifting operations off at least one side of said barge and off at least one end of the barge when said crane is longitudinally located adjacent said one barge end.

7. The method according to claim 6 including performing lifting operations off the opposite end of said barge when said crane is locataed longitudinally adjacent said opposite barge end.

* * * * *